US005356206A

United States Patent [19]

Van Valkenburgh

[11] Patent Number: 5,356,206

[45] Date of Patent: Oct. 18, 1994

[54] HAZARDOUS MATERIAL STORAGE ENCLOSURE UNIT WITH SECONDARY CONTAINMENT SHELF

[76] Inventor: Gary L. Van Valkenburgh, 40 S. Linden Dr., Ventura, Calif. 93004

[21] Appl. No.: 911,201

[22] Filed: Jul. 9, 1992

[51] Int. Cl.[5] ..... A47B 88/00

[52] U.S. Cl. ..... 312/317.1; 248/243

[58] Field of Search ..... 312/209, 306, 317.1, 312/229, 326, 351; 248/243; 220/571, 1.5; 211/187, 117; 108/51.1, 53.1, 93, 91

[56] References Cited

U.S. PATENT DOCUMENTS

| | | | |
|---|---|---|---|
| 2,614,401 | 10/1952 | Roberts | 312/229 |
| 2,814,809 | 12/1957 | Boyle | 312/229 |
| 3,337,283 | 11/1965 | Schlenkert | 312/306 |
| 4,002,383 | 1/1977 | Holloway, Jr. | 312/209 |
| 4,085,987 | 4/1978 | Vartdal | 312/229 |
| 4,122,761 | 10/1978 | Westin et al. | 220/1.5 |
| 4,875,595 | 10/1989 | Van Valkenburg | 220/1.5 |
| 5,052,569 | 10/1991 | Cooper | 220/1.5 |
| 5,099,873 | 3/1992 | Sanchez | 220/571 |

*Primary Examiner*—Kenneth J. Dorner
*Assistant Examiner*—Janet M. Long
*Attorney, Agent, or Firm*—Poms, Smith, Lande & Rose

[57] ABSTRACT

A storage enclosure for storing containers of hazardous materials with a secondary containment feature being provided by at least one secondary containment shelf suspended from a sub-roof assembly by a plurality of support rods, whereby the secondary containment shelves are suspended within the enclosure free of support from and/or engagement with the side, rear, and front walls, so as to facilitate retention of the containers on the shelves in the event of movement of the unit walls in response to any disturbance, such as in an earthquake, or the like, of the unit. The secondary containment shelf is of a very sturdy construction, employing relatively heavy gauge steel sheets having upstanding, liquid-tight, marginal portions providing a secondary containment of spills or leakage of materials from containers stored on the shelf. Each shelf having at least one drain pipe depending therefrom, for facilitating such spillage or leakage from containers stored thereon.

12 Claims, 2 Drawing Sheets

Fig. 1.
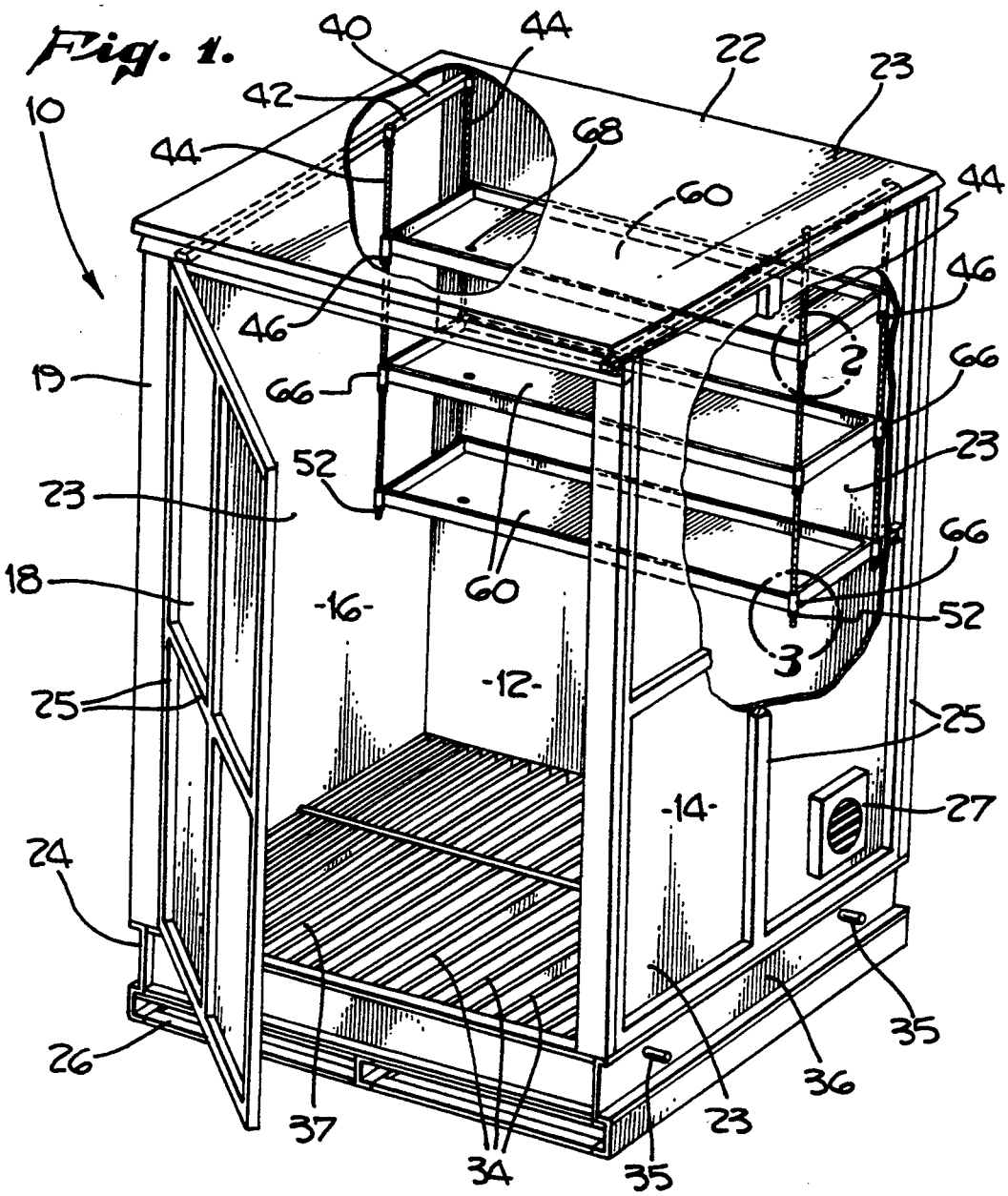
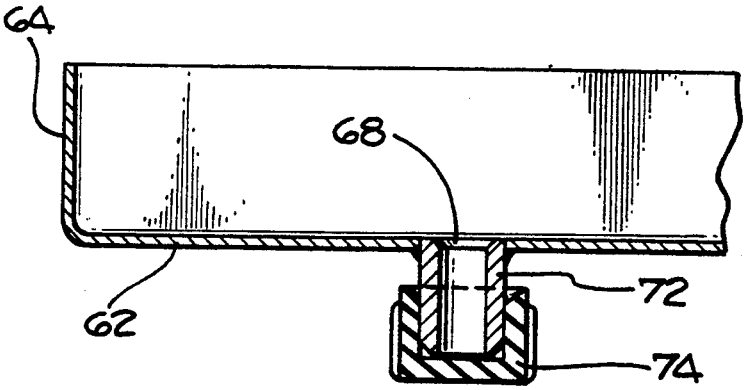
Fig. 5.

Fig. 2.
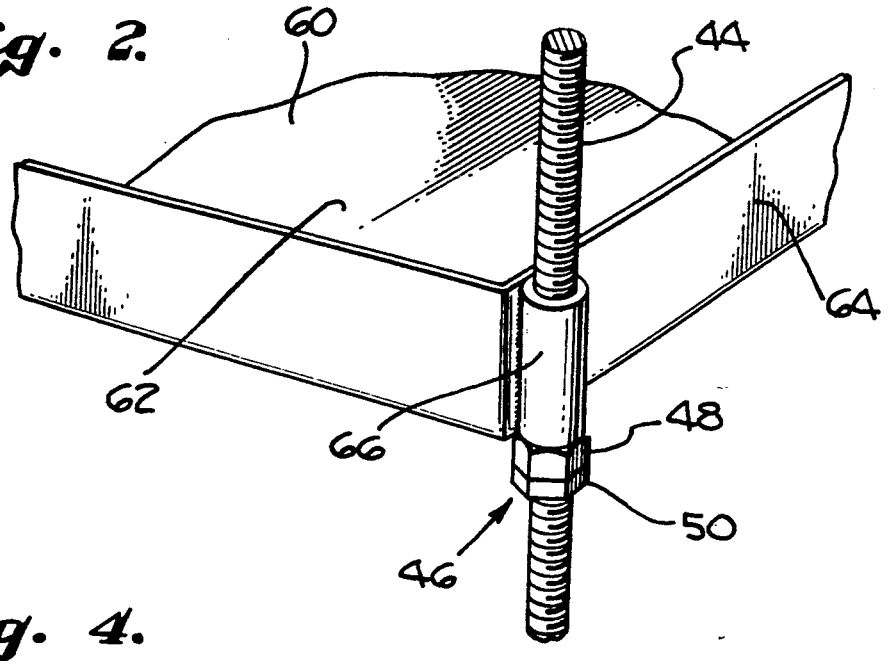
Fig. 4.
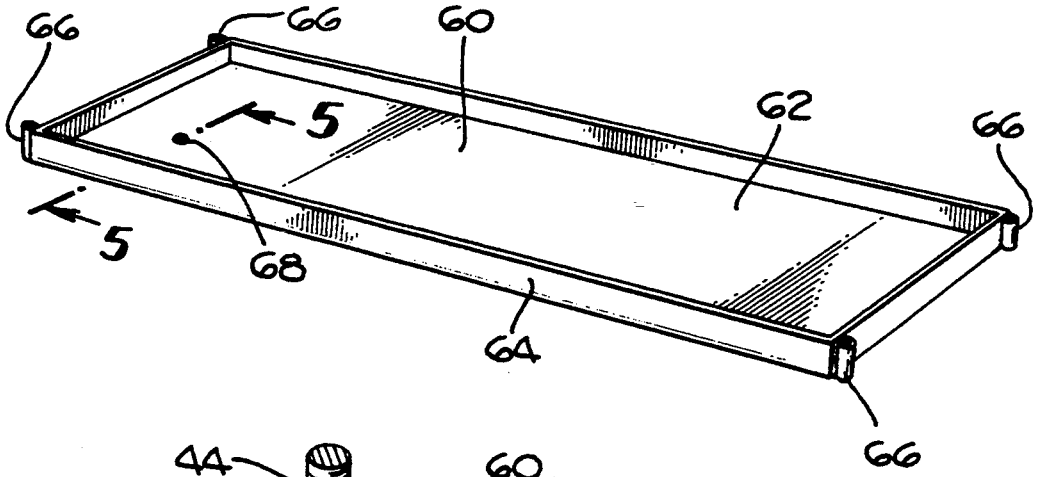
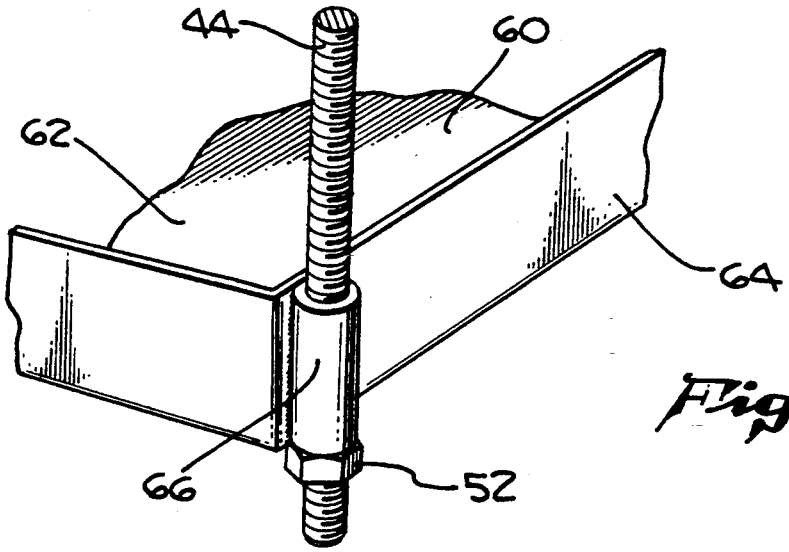
Fig. 3.

HAZARDOUS MATERIAL STORAGE ENCLOSURE UNIT WITH SECONDARY CONTAINMENT SHELF

FIELD OF THE INVENTION

Generally stated, the present invention relates to storage enclosure units housing secondary containment shelves and more particularly, to such storage enclosure units housing secondary containment shelves most suitable for providing protection while storing containers of hazardous materials in such a manner that a secondary containment is provided for any spills or leakage of the containers within the enclosure.

BACKGROUND OF THE INVENTION

The increased recognition of problems attendant the storage and disposal of hazardous materials has caused a need for producers or users of hazardous material to treat the containment and storage of such materials with a greater degree of care than was employed some years ago. It is common to utilize containers such as bottles and canisters and the like, for storing hazardous material before use and in other cases, after the hazardous materials have been produced, but prior to a disposal thereof. It is known to be desirable to provide enclosures for such containers so as to avoid contact therewith by members of the public and/or workers who might not appreciate the danger associated with such materials.

Employers of such units have recognized that these storage units may be jarred from time to time, resulting from the movement of the unit during transportation, the bumping of the building during loading or unloading, or through disturbances and the like. Such agitation of these units has caused containers stored therein to dislodge from the shelves, and fall and break. As discussed above, contact with the hazardous materials stored therein is not desirable and may be dangerous.

Accordingly, it is the primary object of the present invention to disclose and provide secondary containment shelves suitable for such storage enclosures for storing containers of hazardous material which provides for a secured and reliable secondary containment of any spills or leakage which might emanate from the container stored within the enclosure, through the absorption of energy. It is a further object of the present invention to provide such secondary containment shelves which are strong and durable, and free floating, thus preventing items from falling off or spilling.

SUMMARY OF THE INVENTION

Generally stated, the present invention in storage enclosure housing secondary containment shelving includes the provision of a storage enclosure unit for storing containers of hazardous materials whereby this storage enclosure unit provides a primary containment of any spills or leakage of materials from containers stored therein, wherein the storage enclosure unit includes a base, a containment pan providing the primary containment, side and rear walls, a front wall having at least one door, a roof, and housing at least one secondary containment shelf supported by a plurality of rods suspended from a sub-roof frame assembly which is fixedly attached to the storage enclosure unit. More particularly, the secondary containment shelf housed within the enclosure unit includes upstanding liquid tight marginal portions providing a secondary containment of spills or leakage of materials from containers stored on the shelves, the support means associated with the shelves are suspended independent of the side, rear, and front walls. Accordingly, these secondary containment shelves are suspended within the enclosure from the sub-roof frame free of support from and/or engagement with the side, rear, and front walls, so as to facilitate retention of the containers on the shelves in the event of movement of the unit walls in response to any disturbance of the unit.

The secondary containment shelves are also preferably provided with at least one drain pipe depending from a hole in the bottom of the shelf. This drain pipe provides a means for draining contained spills or leakage of materials from containers stored on the shelves. The drain pipe is engaged by an adjustable closure element permitting the employer of these units to freely purge the shelves of any hazardous materials which have accumulated thereon.

A strong structural secondary containment shelf is provided in accordance with the present invention through the use of relatively heavy gage steel sheets having upstanding liquid type marginal portions. Similarly, a strong structural enclosure unit is provided in accordance with the present invention through the use of relatively heavy gage steel panels and associated tubular steel frames whereby each of the side walls and rear walls are formed of individual integral steel panels. Similarly, the roof and front door panels are constructed of relatively heavy gage steel sheets. Venting of the enclosure unit is provided by vents on each of the enclosure unit's side walls. This venting facilitates the relief of any internal pressures which might build up.

A better understanding of the structure of the storage enclosure unit and the secondary containment shelf housed therein in accordance with the present invention, as well as a recognition of additional advantages and objects thereof, will be afforded to those skilled in the art from a consideration of the following detailed description of a preferred exemplary embodiment thereof. Reference will be made to the appended sheets of drawings which will be first described briefly.

BRIEF DESCRIPTION OF THE DRAWINGS

FIG. 1 is a frontal perspective view of an exemplary embodiment of the storage enclosure unit with partial cutaways revealing the secondary containment shelves suspended therein in accordance with the present invention.

FIG. 2 is a perspective and cutaway view of the adjustable support means of the upper shelf of FIG. 1.

FIG. 3 is a perspective and cutaway view of the non-adjustable support means associated with the bottom secondary containment shelves of FIG. 1.

FIG. 4 is a perspective view of a secondary containment shelf in accordance with the present invention.

FIG. 5 is a cross-sectional and cutaway view taken along the plane 5—5 of FIG. 4 illustrating the adjustable drain means depending from the secondary containment shelf of FIG. 4.

DETAILED DESCRIPTION

Referring initially to FIG. 1, the preferred exemplary embodiment of the storage enclosure unit and the secondary containment shelving housed therein, in accordance with the present invention, includes a storage enclosure unit 10, sub-roof frame assembly 40, a plurality of support rods 44 suspended from sub-roof frame 40 and at least one secondary containment shelf 60 supported by support rods 44 independent of the storage enclosure unit's side, rear, and front walls.

Storage enclosure unit 10 was earlier contemplated in U.S. Pat. No. 4,875,595. Enclosure unit 10 which includes a rear wall indicated generally at 12, right hand side wall indicated generally at 14, left hand side wall indicated generally at 16, front wall/unit door 18 movably attached to left hand side wall 16 by a hinge means, a roof indicated generally at 22, and a base indicated generally at 24. The front wall may in the alternative have a single door or multiple of doors associated with it for access to the interior of the enclosure.

The side walls, indicated generally at 14 and 16 in FIG. 1, are preferably fabricated from heavy gage non-commercial grade steel sheets 23 secured to tubular steel members 25 provided in a box frame with cross braces, as by welding, to provide for a very sturdy construction. Each of the side walls 14 and 16 is provided with a vent 27, each vent comprising simply an aperture through the associated panel with a heavy wire mesh screen covering the same.

The rear wall, indicated generally at 12 in FIG. 1 is preferably fabricated from heavy gauge non-commercial grade steel sheet 23 secured to tubular steel members 25 of box configuration with vertical and cross braces, as by welding, to provide a solid impenetrable panel across the rear of the enclosure. The front, rear, and side walls may be assembled to one another in a permanent fashion, as by welding of the various wall frame members to another in a permanent assembly.

The front wall, indicated generally at 18 is fabricated of tubular steel members 25 provided in a box frame with vertical and cross braces, with heavy gauge non-commercial steel sheet panel secured to the frame, as by welding, to provide a very sturdy construction resisting unauthorized entry. Appropriate hinges may be mounted to the door jams 19 for mounting the door and for providing swinging movement between opened and closed positions. The door frames thus provided are welded or otherwise securely fastened to left hand side wall 16. As illustrated in FIG. 1 the door may integrate the entire front wall or in the alternative, a single or multiple smaller doors may occupy a portion of the front wall in accordance with degree of access to the interior of the enclosure desired.

The roof indicated generally at 22 is constructed of a steel sheet panel 23, preferably heavy gage non-commercial sheet steel, secured to the tubular steel members 25 of the individual walls, as by welding.

The base indicated generally at 24 includes a plurality of support beams 35 providing a plurality of spaced support surfaces for the enclosure and its associated containment pan as subsequently described. The base includes a plurality of channel members 34 which have upstanding webs relative a base flange as seen in FIG. 1. Tubular steel support beams 35 are provided laterally across the channel members. The support beams 35 provide a plurality of spaced support surfaces upon which the container pan is seated as subsequently described. The channel members mount the support beams spaced above floor level to facilitate a fork lift mobility for the enclosure unit indicated generally at 26. A plurality of side beams 35 are incorporated to provide a surrounding plurality of side surfaces extending vertically above the upper surfaces of the support beams. End side walls 36 of the base 24 with the beams provide a rectangular side wall enclosure of side surfaces extending vertically above the support beams. The support beams and side walls 36 thus provide a support framework for receiving and supporting a containment pan therein.

The containment pan is initially fabricated from a single sheet of steel. Marginal portions are bent upwardly by known means relative a central bottom portion with the four corners thus provided being welded closed. The one piece pan thus constructed is rested within the side walls of the base frame upon the support beams as discussed in said U.S. Pat. No. 4,875,595.

To facilitate such spillage or leakage from containers within the enclosure entering the containment pan, a removable grate 37 is provided upon and extending over marginal end portions of the runners. The marginal end portions of the runners, may be notched to facilitate receiving the removable grate which, in exemplary embodiment is thicker than the floor facing.

As particularly contemplated within the present invention, housed within this enclosure unit are at least one secondary containment shelf 60, a sub-roof frame assembly 40, a plurality of support rods 44, and means for supporting the secondary containment shelf free from engagement with the side, rear and front walls of the enclosure unit.

Referring to FIG. 1, a sub-roof frame assembly 40, which includes sub-roof cross beams 42, a plurality of support rods 44, and means for supporting the secondary containment shelves independent from the side rear and front walls of the storage enclosure unit, is secured to the inside portions of the front and rear walls of the storage enclosure unit. The sub-roof assembly cross beams 42, preferably constructed of a rigid material, are fixedly attached within the storage enclosure unit below the roof in a parallel orientation with the side walls 14 and 16.

These cross beams 42 must be located sufficiently distant from the side walls so as to prevent the shelves, suspended therefrom, from contacting the walls of the enclosure unit in the event of any disturbance. Support rods 44 depend from the cross beams 42 below the roof of the storage enclosure. The support rods 44 depending from cross beams 42 must be positioned on cross beams 42 to accommodate the secondary containment shelves, supported thereby, free from support from or engagement with the side, rear, and front walls of the enclosure unit, so as to facilitate retention of the containers on the shelves in the event of movement of the unit walls in response to any disturbance of the unit.

The means for supporting the secondary containment shelving within the enclosure unit free of support from and/or engagement with the side, rear, and front walls of the enclosure unit includes support rods 44, guide sleeves 66, and lock nut assemblies 46 or 52. The support rods 44 are preferably constructed of steel and have a threaded exterior portion. As illustrated in FIGS. 2 and 3 the guide sleeve 66 of the secondary containment shelves 60 receive the support rods therethrough.

Referring to FIG. 2 the regions of the support rods associated with the upper secondary containment shelves are further engaged by lock nut assembly 46. Lock nut assembly 46 comprises hex nut 48 and hex jam nut 50 which working in unison provide means for latitudinally adjusting the secondary containment shelves supported by these rods 44 within the enclosure unit.

Referring now to FIG. 3 the portion of the support rods 44 engaged by the shelf guide sleeves 66 of the bottom shelf 60 are further engaged by a non-adjustable lock nut 52. This non-adjustable lock nut has a nylon insert, preferably neoprene, which resists movement and subsequently locks the bottom shelf into a more permanent, not readily adjustable position.

Referring to FIG. 4 the secondary containment shelves 60 are initially fabricated from a single sheet of steel. Marginal portions 64 are bent upwardly by known means relative a central portion 62 with the four corners thus provided being welded closed. The upstanding liquid tight marginal portions provide a secondary containment of spills or leakage of materials from containers stored on the shelf. As seen in FIGS. 2 and 3 guide sleeves 66 are secured to the upstanding liquid tight marginal portions of the secondary containment shelves, as by welding. These sleeves preferably constructed from tubular steel are suitable for receiving the support rods 44 therethrough.

Associated with each shelf 60 is at least one drain hole 68. A drain pipe 72 depends from drain hole 68 and is positioned on the bottom of shelf bottom portion 62. The drain pipe 72 is engaged by an adjustable closure element 74. As illustrated in FIG. 5, the closure element 74 externally engages the drain pipe 72. Such engagement may include a threaded relationship or a friction fit. This drain assembly illustrated in FIG. 5 may alternatively encompass a variety of different relationships including an internally threaded drain pipe engaged by an externally threaded closure element, or a stop-cock secured to the bottom end of the drain pipe. The drain pipe facilitates such spillage or leakage of hazardous materials from containers stored thereon.

While the exemplary embodiment of rods and shelves disclosed employ steel construction, it is contemplated that a durable plastic or fiberglass material construction might be used to provide a lightweight yet strong alternative to steel. Plastics including neoprene cross-link, polypropylene and/or polyethylene materials are believed to be suitable alternative materials for use in the construction of the secondary containment shelves and support rod system.

It should now be apparent to those skilled in the art from a consideration of the foregoing detailed description of an exemplary embodiment of a storage enclosure unit housing secondary containment shelving in accordance with the present invention, that a secondary containment is provided in the within invention in storage enclosure for containing and storing hazardous materials which might spill or leak from containers stored within the enclosure. Further, the prevention of additional damage resulting from any disturbance, or the like, causing items stored therein to dislodge from the shelves and fall and break, is facilitated by the suspension of secondary containment shelves within the enclosure from the sub-roof frame free of support from and/or engagement with the side, rear, and front walls, so as to facilitate retention of the containers on the shelves in the event of movement of the unit walls in response to any disturbance of the unit such as in an earthquake.

Having thus described the preferred exemplary embodiment of the present invention, a storage enclosure housing secondary containment shelving, it should also be apparent to those skilled in the art that various advantages and additional objects of the within invention have been afforded thereby, and that various modifications, adaptations and other embodiments of the storage enclosure may be made within the scope and spirit of the present invention which are defined by the following claims.

I claim:

1. A storage enclosure unit for storing containers of hazardous material providing for a primary containment of any spills or leakage of materials from said containers: said enclosure unit having a base, a primary containment pan providing said primary containment, side and rear walls, a front wall having at least one door and a roof, the improvement comprising:

a plurality of secondary containment shelves, said shelves having upstanding liquid tight marginal portions for providing a secondary containment of spills or leakage of material from containers stored on said shelves;

a sub-roof frame assembly fixedly attached to said storage enclosure unit above said primary containment pan;

a plurality of support rods suspended from said sub-roof frame assembly and depending therefrom below said roof within said storage enclosure and the above said primary containment pan;

support means, associated with each of said plurality of secondary containment shelves, for supporting said secondary containment shelves on said suspended support rods independent of said side, rear, and front walls above said primary containment pan, whereby said plurality of secondary containment shelves are suspended within said enclosure unit from said sub-roof frame assembly free of support from and/or engagement with said side, rear, and front walls, so as to facilitate retention of said containers on said shelves in the event of movement of said unit walls in response to any disturbance of said unit, such as in an earthquake;

wherein said plurality of secondary containment shelves are provided in a vertical array above said primary containment pan.

2. The storage enclosure unit of claim 1 wherein:

said support means is associated with each other of said shelves in a vertically adjustable manner.

3. The storage enclosure unit of claim 1 wherein said support means is associated with a bottom shelf of said shelves in a non-adjustable manner.

4. The storage enclosure unit of claim 1 wherein at least one of said secondary containment shelves comprises:

at least one drain pipe descending from at least one hole in the bottom of said shelf directly above said primary containment pan for draining contained spills or leakage of materials from containers stored on said shelf to said pan; and a plurality of fixedly attached guide sleeves suitable for receiving said support rods therethrough.

5. In a storage enclosure unit for storing containers of hazardous material, providing for primary containment of any spills or leakage of materials from said containers, said enclosure unit having a base, a primary containment pan providing said primary containment, side and rear walls, a front wall having at least one door and a roof, the improvement comprising:

(a) a plurality of secondary containment shelves, each of said shelves having upstanding liquid tight marginal portions providing a secondary containment of spills or leakage of materials from containers stored on said shelves;

(b) a plurality of support rods suspended independently of said side, rear and front wails within said storage enclosure and above said pan; and (c) means for supporting said shelves on said suspended support rods above said pan in a vertical array and independent of said side, rear, and front walls, whereby said secondary containment shelves are suspended within said enclosure free of support from and/or engagement with said side, rear, and front walls, so as to facilitate retention of said containers on said shelves in the event of movement of said unit walls in response to any disturbance of said unit, such as in an earthquake.

6. The storage enclosure unit of claim 5 wherein:

said means of supporting said shelves is associated with an upper shelf of said shelves for supporting said upper shelf for being vertically adjustable.

7. The storage enclosure unit of claim 6 wherein said means of supporting said shelves is associated with bottom shelf of said shelves for supporting said shelf to be vertically non-adjustable.

8. The storage enclosure unit of claim 5 wherein each secondary containment shelf of said shelves comprises:

at least one drain pipe descending from at least one hole in the bottom of said shelf providing means for draining contained spills or leakage of materials from containers stored on said shelves to said containment pan; and a plurality of fixedly attached guide sleeves suitable for receiving said support rods therethrough.

9. In a storage enclosure unit for storing containers of hazardous material, providing for primary containment of any spills or leakage of materials from said containers, said enclosure unit having a base, a primary containment pan providing said primary containment, side and rear walls, a front wall having at least one door and a roof, the improvement comprising:

(a) a plurality of secondary containment shelves, each of said shelves having upstanding liquid tight marginal portions providing a secondary containment of spills or leakage of materials from containers stored on said shelves;

(b) a plurality of support rods suspended independently of said side, rear and front walls within said storage enclosure above said pan; and (c) means for supporting said secondary containment shelves on said suspended support rods above said pan independent of said side, rear, and front walls, whereby said secondary containment shelves are suspended within said enclosure above said pan free of support from and/or engagement with said side, rear, and front walls, so as to facilitate retention of said containers on said shelves in the event of movement of said unit walls in response to any disturbance of said unit such as in an earthquake;

wherein each of said secondary containment shelves defines at least one hole in a bottom portion thereof and includes at least one drain pipe descending from said at least one hole for draining contained spills or leakage of materials from containers stored on said shelves into said containment pan;

wherein each of said secondary containment shelves includes a plurality of fixedly attached guide sleeves suitable for receiving said support rods therethrough; and wherein each said drain pipes are engaged by an adjustable closure element.

10. In a storage enclosure unit for storing containers of hazardous material providing for a primary containment of any spills or leakage of materials from said containers; said enclosure unit having means for primary containment across the bottom of said unit, a plurality of walls, at least one door and a roof, the improvement comprising:

a plurality of secondary containment shelves, each of said shelves having upstanding liquid tight marginal portions, providing a secondary containment of spills or leakage of materials from containers stored on said shelves;

a plurality of support rods suspended from below said roof within said storage enclosure and above said means for primary containment;

support means for supporting said shelves on said suspended support rods in a vertical array above said means for primary containment and independent of said unit walls, whereby said secondary containment shelves are suspended within said enclosure in a vertical array above said means for primary containment free of support from and/or engagement with said unit walls, so as to facilitate retention of said containers on said shelves in the event of movement of said unit walls in response to any disturbance of said unit, such as in an earthquake.

11. The storage enclosure unit of claim 10 wherein:

said support means is associated with an upper shelf of said shelves for supporting said upper shelf to be vertically adjustable.

12. The storage enclosure unit of claim 10 wherein each of said secondary containment shelf shelf comprises:

at least one drain pipe descending from at least one hole in the bottom of said shelf above said means for primary containment providing means for draining contained spills or leakage of materials from containers stored on said shelves into said means for primary containment.

* * * * *